US011253125B1

(12) United States Patent
Hoyt

(10) Patent No.: US 11,253,125 B1
(45) Date of Patent: Feb. 22, 2022

(54) VACUUM SYSTEM

(71) Applicant: Keith Hoyt, Merced, CA (US)

(72) Inventor: Keith Hoyt, Merced, CA (US)

( * ) Notice: Subject to any disclaimer, the term of this patent is extended or adjusted under 35 U.S.C. 154(b) by 223 days.

(21) Appl. No.: 16/688,147

(22) Filed: Nov. 19, 2019

(51) Int. Cl.

| | |
|---|---|
| ***A47L 9/32*** | (2006.01) |
| ***A47L 5/22*** | (2006.01) |
| ***A47L 5/24*** | (2006.01) |
| ***A47L 5/36*** | (2006.01) |
| ***A47L 9/06*** | (2006.01) |
| ***A47L 9/10*** | (2006.01) |
| ***A47L 9/24*** | (2006.01) |

(52) U.S. Cl.
CPC ..... *A47L 9/327* (2013.01); *A47L 5/225* (2013.01); *A47L 5/24* (2013.01); *A47L 5/362* (2013.01); *A47L 9/0606* (2013.01); *A47L 9/102* (2013.01); *A47L 9/248* (2013.01)

(58) Field of Classification Search
CPC . A47L 9/327; A47L 5/225; A47L 5/24; A47L 5/362; A47L 9/0606; A47L 9/102; A47L 9/248
See application file for complete search history.

(56) References Cited

U.S. PATENT DOCUMENTS

| | | | | |
|---|---|---|---|---|
| 187,238 | A | 2/1877 | Somers | |
| 5,371,912 | A * | 12/1994 | Hall | A47L 11/125 15/50.1 |
| 5,533,222 | A * | 7/1996 | Lelkes | A46B 13/003 15/230 |
| 6,763,549 | B1 * | 7/2004 | Peters | A47L 5/26 15/374 |
| 9,462,923 | B2 * | 10/2016 | Powell | A47L 13/44 |
| 10,806,320 | B1 * | 10/2020 | Welbourne | A46B 9/005 |
| 2004/0187238 | A1 * | 9/2004 | Young | A47L 11/4036 15/98 |
| 2006/0182487 | A1 * | 8/2006 | Sandoval | A47L 13/22 401/140 |
| 2012/0000030 | A1 * | 1/2012 | Conrad | A47L 5/28 15/329 |
| 2014/0237755 | A1 * | 8/2014 | Conrad | A47L 9/0018 15/329 |
| 2014/0237965 | A1 * | 8/2014 | Conrad | A47L 9/1683 55/459.1 |
| 2015/0320275 | A1 * | 11/2015 | Borges | A47L 9/0693 134/21 |

(Continued)

*Primary Examiner* — Marc Carlson
(74) *Attorney, Agent, or Firm* — Sanchelima & Associates, P.A.; Christian Sanchelima; Jesus Sanchelima

(57) ABSTRACT

A vacuum system for vacuuming is disclosed. The vacuum system includes a baseboard cleaning attachment, a floor cleaning attachment, and a hose attachment. Each of the attachments is selectively mounted to a hose of the vacuum system for vacuuming floors, baseboards and tight spaces. The baseboard cleaning attachment includes a brush head having a right-angled portion, and a curved portion. The brush head includes a neck to mount the brush head to the hose. The right-angled portion is aligned with the baseboard and is used to vacuum. The floor cleaning attachment includes an elongated tube, and an under furniture handle mounted to the elongated tube. The elongated tube includes a beater head with a beater. The elongated tube is mounted to the hose, and the under furniture handle is used vacuum under furniture. The hose attachment is in an S-shape for tight spaces.

11 Claims, 9 Drawing Sheets

(56) References Cited

U.S. PATENT DOCUMENTS

| | | | | |
|---|---|---|---|---|
| 2017/0065136 | A1* | 3/2017 | Latimer | A47L 9/1418 |
| 2019/0082920 | A1* | 3/2019 | Chavana, Jr. | A47L 11/201 |
| 2019/0239705 | A1* | 8/2019 | Tsuchida | A47L 5/362 |
| 2019/0357740 | A1* | 11/2019 | Thorne | A47L 5/24 |

* cited by examiner

VACUUM SYSTEM

BACKGROUND OF THE INVENTION

1. Field of the Invention

The present invention generally relates to a vacuum system for vacuuming floor and baseboards. More particularly, the present invention relates to a vacuum system such as a vacuum cleaner for vacuuming or cleaning floors and baseboards without bending or getting down on hands and knees on the floor.

2. Description of the Related Art

It is known that a baseboard is used to cover the joint between wall surface and floor. The baseboard is also known as skirting board, skirting, mopboard, floor molding, floor trim, and base molding. Generally, the baseboard is used to cover uneven edge of flooring next to the wall and to protect the wall from kicks, abrasion, and furniture. Additionally, the baseboard can be used as a decorative molding. Typically, the baseboard is provided as a plank or plastic nailed, screwed or glued to the wall. Alternatively, the baseboard is made up of molding when used for decoration.

Although the baseboards are useful, it is always a difficult task to clean the baseboards. Typically, the baseboards are dusted using a broom or a vacuum cleaner brush. However, due to the construction of conventional brooms and the vacuum cleaners, the baseboards can only be dusted. In order to thoroughly clean the baseboards, the person cleaning the baseboards must get down on hands and knees on the floor and use a sponge or scrubber to eliminate stubborn marks or accumulation of dust. Bending over or getting down on hands and knees on the floor and to reach the baseboards to clean the baseboards creates too much stress on back of the person. The person may be further stressed if the baseboards are located behind headboards, in laundry rooms, or behind large furniture.

In order to overcome the problems associated with cleaning the baseboards, several solutions have been provided in the past. One such solution includes providing an apparatus for cleaning baseboards and edge regions of floors that are adjacent to walls or other vertically extending surfaces. An example of such a solution is disclosed in a United States patent application 20040187238. In US20040187238A1, it is disclosed that a baseboard corner and edge-cleaning machine comprises an upper trapezoidal-shaped plate having a bore. A bracket is connected to the upper trapezoidal-shaped plate. A support arm is attached to the bracket. A motor is seated inside the upper trapezoidal-shaped plate. An orbital is attached to and powered by the motor. A lower trapezoidal-shaped plate has rubber grommets and a bottom surface. The lower trapezoidal-shaped plate is attached to the upper trapezoidal-shaped plate. An adhesive scrubbing pad is peripherally attached to the baseboard corner and edge cleaning machine and an aggressive scrubbing pad is attached to the bottom surface of the lower trapezoidal-shaped plate.

Another example is disclosed in a U.S. Pat. No. 9,462,923. In U.S. Pat. No. 9,462,923B2, it is disclosed that an apparatus for cleaning baseboards includes a cleaning head having a bi-directionally adjustable handle coupled thereto via a pivot assembly. The cleaning head includes a plurality of plates between which a plurality of pads is secured in stacked fashion.

Another example is disclosed in a U.S. Pat. No. 6,763,549. In U.S. Pat. No. 6,763,549B1, it is disclosed that a vacuum cleaning apparatus having a rotary brush situated at an air intake opening in a housing has a configuration which enables efficient cleaning of edge portions of a floor that are adjacent to a wall or other vertical surface. A cleaning head portion of the housing has intersecting sidewalls, which extend at right angles to each other enabling one sidewall to face the edge of a floor while the other sidewall faces the lower edge of an adjacent wall. The air intake opening is angled to extend into both of the angled intersecting sidewalls of the cleaning head. The rotary brush carries bristles, which protrude through the air intake opening at both of the sidewalls of the cleaning head and at the intersection between the sidewalls.

Although the vacuum cleaning apparatuses discussed above are useful in cleaning the floor and edge regions of floors, they have few problems. For instance, the user of the vacuum cleaning vacuum system may have to the shift or move the furniture to clean the floor under the furniture and the baseboard behind the furniture. After vacuuming, the user has to put back the furniture in its original place. This may lead to stress on the back of the user. As a result, the existing vacuum cleaning apparatuses are not suitable for cleaning floor and baseboards.

Other documents describing the closest subject matter provide for a number of more or less complicated features that fail to solve the problem in an efficient and economical way. None of these patents suggest the novel features of the present invention. Specifically, none of the inventions in the art disclose a vacuum system for cleaning floor and baseboards without bending or getting down on hands and knees on the floor. Specifically, none of the inventions in the art disclose a vacuum system that disclose a baseboard cleaning attachment, a floor cleaning attachment and a hose attachment that are interchangeably used for vacuuming baseboard, floor and tight spaces in the house without the user having to bend or get down on hands and knees on the floor.

Therefore, there is a need in the art for a vacuum system for vacuuming floor and baseboards so a user does not have to be on their hands and knees to accomplish the task while providing a fast and effective way to vacuum the floor and baseboard and to avoid the above mentioned problems.

SUMMARY OF THE INVENTION

It is one of the objects of the present invention to provide a vacuum system for vacuuming floor and baseboards and that avoids the drawbacks of the prior art.

It is another object of the present invention to provide a vacuum system for vacuuming floor and baseboards without the user getting down on hands and knees on the floor and bending over to reach the baseboards to vacuum the baseboards.

It is yet another object of the present invention to provide a vacuum system for vacuuming floor and baseboards that is portable with the use of, for example, handles or straps.

It is still another object of the present invention to provide a vacuum system for vacuuming floors and baseboards that is easily maneuvered under and around furniture.

It is yet another object of the present invention to provide a vacuum system for vacuuming floor and baseboards that can clean up various different type of surfaces.

It is another object of the present invention to provide a vacuum system for vacuuming floor and baseboards that can reach tight or hard to reach spaces for cleaning thereof.

In yet another object of the present invention to provide a vacuum system for vacuuming floor and baseboards that can be powered by different power sources such as AC or DC power.

It is still an object of the present invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

Features and advantages of the subject matter hereof will become more apparent in light of the following detailed description of selected embodiments, as illustrated in the accompanying figures. As will be realized, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit invention, as one or ordinary skill in the art will understand that variations can be substituted that are within the scope of the invention as described.

The present invention discloses a vacuum system for vacuuming floor and baseboards. The vacuum system may be used as a vacuum cleaner. The vacuum system comprises a baseboard cleaning attachment, a floor cleaning attachment, and a hose attachment. Each of the baseboard cleaning attachment, the floor cleaning attachment, and the hose attachment is selectively mounted to a hose or a support handle mounted to the hose of the vacuum system for vacuuming baseboards, floor under furniture, and tight spaces, respectively. The baseboard cleaning attachment comprises a brush head having a right-angled portion and a curved portion opposite to the right-angled portion. The brush head comprises a neck to mount the brush head to the hose. The right-angled portion is aligned with the baseboard and is used to vacuum the baseboards.

The floor cleaning attachment comprises an elongated tube, and an under furniture handle pivotally mounted to the elongated tube. The elongated tube comprises a beater head having a beater bar. The elongated tube is mounted to the hose of the vacuum system and the under furniture handle is used to lay the elongated tube on floor and to position the beater head under the furniture to vacuum under furniture.

The hose attachment is provided as a S-shaped tube for vacuuming tight spaces.

The baseboard cleaning attachment, the floor cleaning attachment, and the hose attachment help in vacuuming the baseboards, floor, and tight spaces without the user having to bend or get down on hands and knees on the floor.

Various features and embodiments of a vacuum system for vacuuming floor and baseboards are explained in conjunction with the description of FIGS. 1-9.

Figure 1:
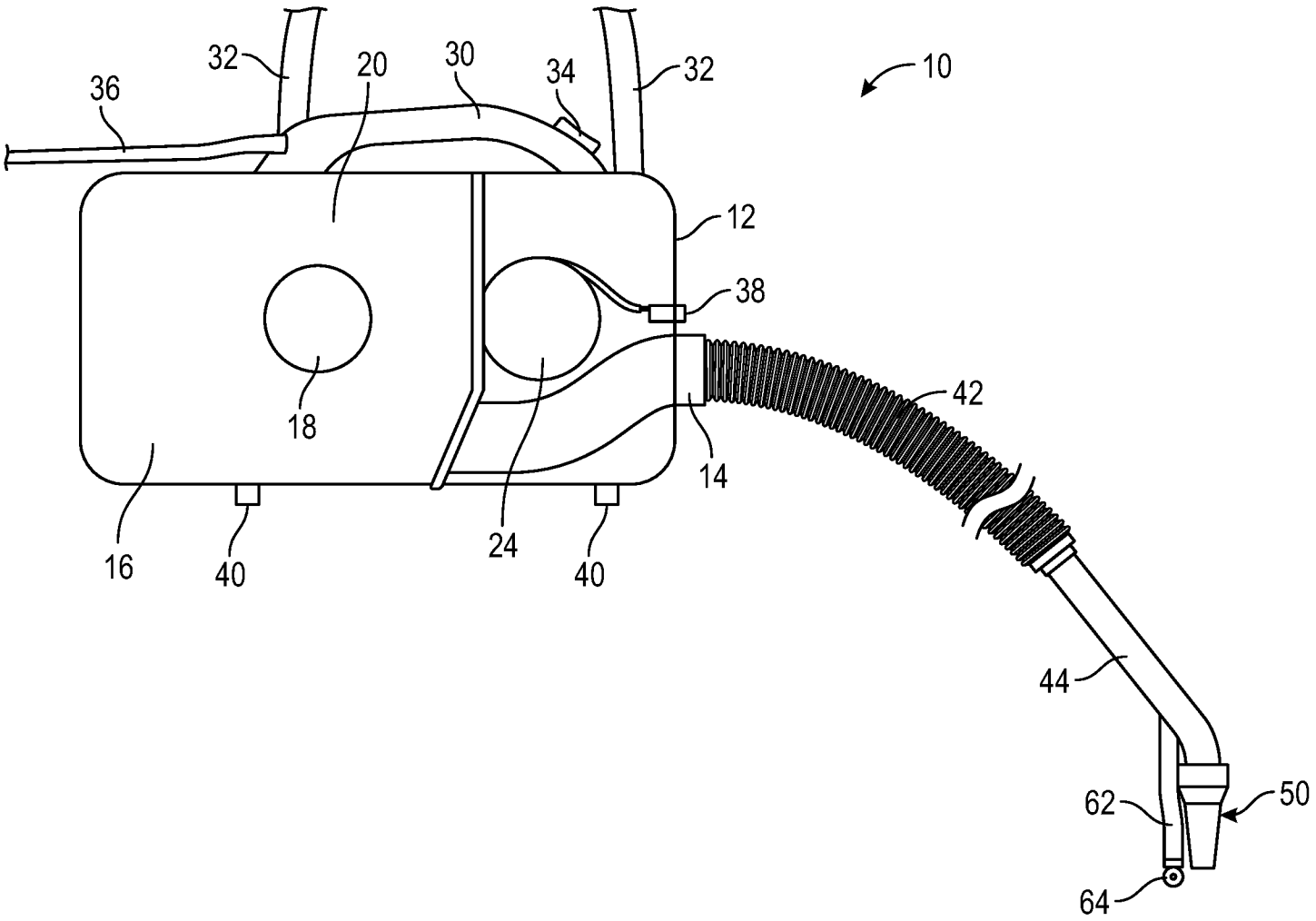
FIG. 1 illustrates a side view of a vacuum system 10 including a baseboard cleaning attachment 50, in accordance with one embodiment of the present invention.
Figure 2:
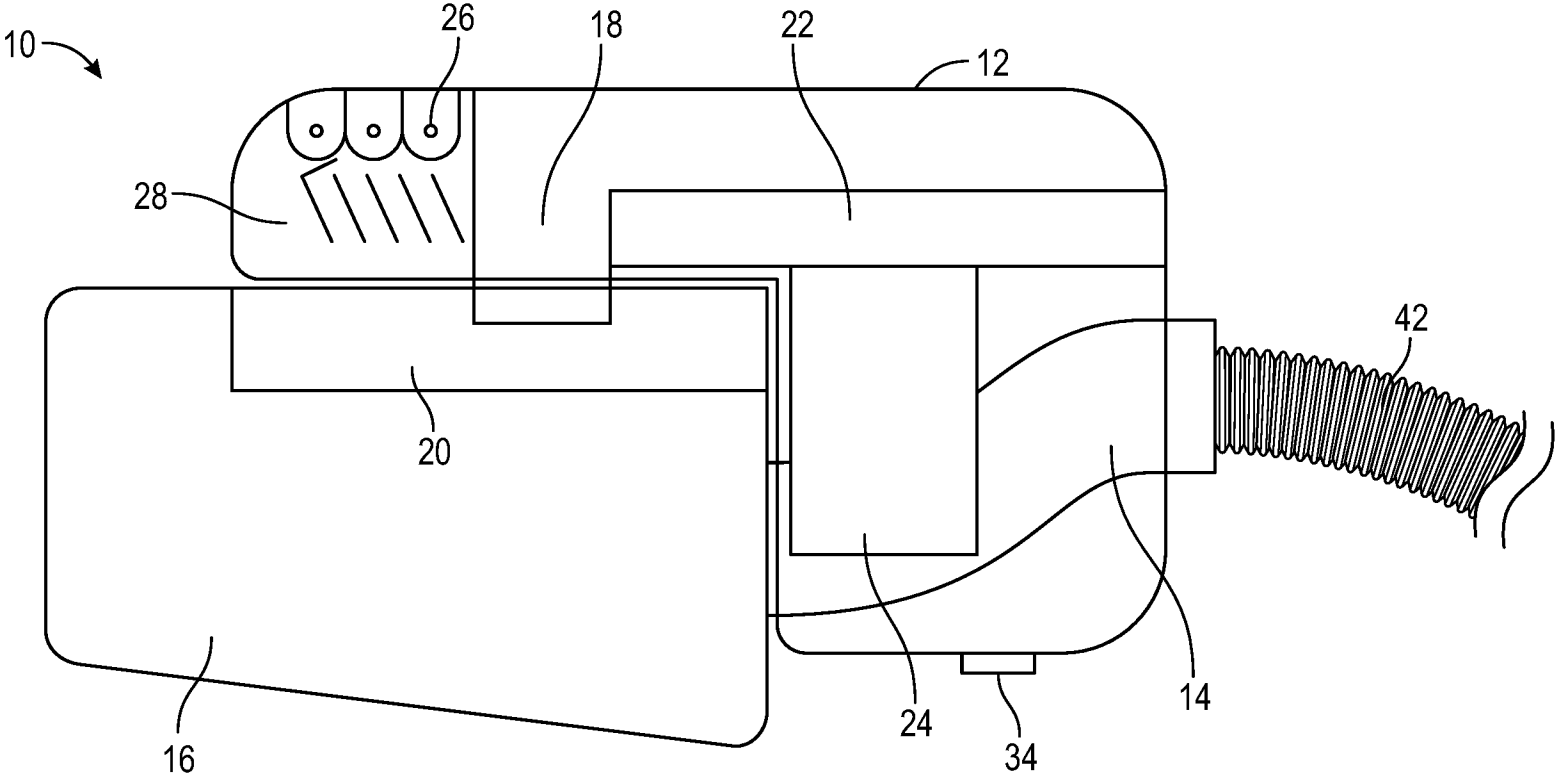
FIG. 2 illustrates a top view of a vacuum system 10 including a baseboard cleaning attachment 50, in accordance with one embodiment of the present invention.

Referring to FIGS. 1 and 2, a side and top view, respectively of a vacuum system 10 for vacuuming baseboards is shown, in accordance with one embodiment of the present invention. The vacuum system 10 comprises a housing 12. The housing 12 might indicate a container, a casing, or receptacle made up of metal, plastic or any other suitable material. The housing 12 might be provided in variety of shapes and sizes depending upon the need.

The housing 12 comprises an inlet 14. The inlet 14 may indicate a pipe or hollow tube used for drawing dust or debris into the housing 12. In one implementation, the inlet 14 might be made using flexible or rigid material. The housing 12 may comprise a dust collection chamber 16. The dust collection chamber 16 might be made up of plastic or fabric or any other suitable material. The dust collection chamber 16 is mounted to the inlet 14 as shown in FIG. 2. Further, the housing 12 comprises a suction tube 18 mounted to the dust collection chamber 16 via a filter 20. In other words, the filter 20 is placed between the dust collection chamber 16 and the suction tube 18. The filter 20 may include a High Efficiency Particulate Air (HEPA) filter or Ultra Low Penetration Air (ULPA) filter. Alternatively, the filter 20 may include a fabric, foam or disk filter.

The suction tube 18 is further mounted to a pump 22. The pump 22 is mounted to a first motor 24. In one example, the first motor 24 might be operated using a battery 26. The battery 26 might be removably mounted in the housing 12 for easy replacing. The housing 12 further comprises an exhaust port 28 to draw and dispense residual air into atmosphere or environment from the filter 20.

In one implementation, the housing 12 might be provided with a handle 30 for holding the housing 12. Further, the housing 12 is provided with shoulder straps 32 for supporting the housing 12 over shoulders of a user. Further, the housing 12 is provided with an actuator 34 indicative of a button for powering ON and OFF the motor 24. In one implementation, the housing 12 might be provided with a cable 36 for charging the battery 26 or to operate the motor 24 directly from an Alternating Current, AC source. The cable 26 might be detachably mounted to the battery 26 so as to use the vacuum system 10 as a stand-alone device for vacuuming floor and/or baseboards.

Additionally, the housing 12 is provided with a beater plug 38 indicative of a cable extending from the motor 24 or the battery 26. The beater plug 38 is used to mount a beater cable for operating a cleaning attachment mounted to the housing 12 for vacuuming floor and other places. The functioning of the beater plug and the cleaning attachment is explained in later part of the description. Further, the housing 12 comprises a base support 40. The base support 40 might be made up of rubber or any other soft material to withstand wear and tear of the housing 12 when placed on a surface such as a floor or table.

The vacuum system 10 further comprises a hose 42 removably mounted to the inlet 14. The hose 42 might be made up of rigid or flexible material. The hose 42 might be selected having suitable length based on the need. Further, hose 42 might be provided with a support handle 44. The support handle 44 might indicate an extension tube made of plastic or any other suitable material. In one example, support handle 44 might have a length of two or three feet. Support handle 44 might be provided in a straight or bent configuration. Support handle 44 may aid in reaching hard to reach spaces or areas.

Figure 3:
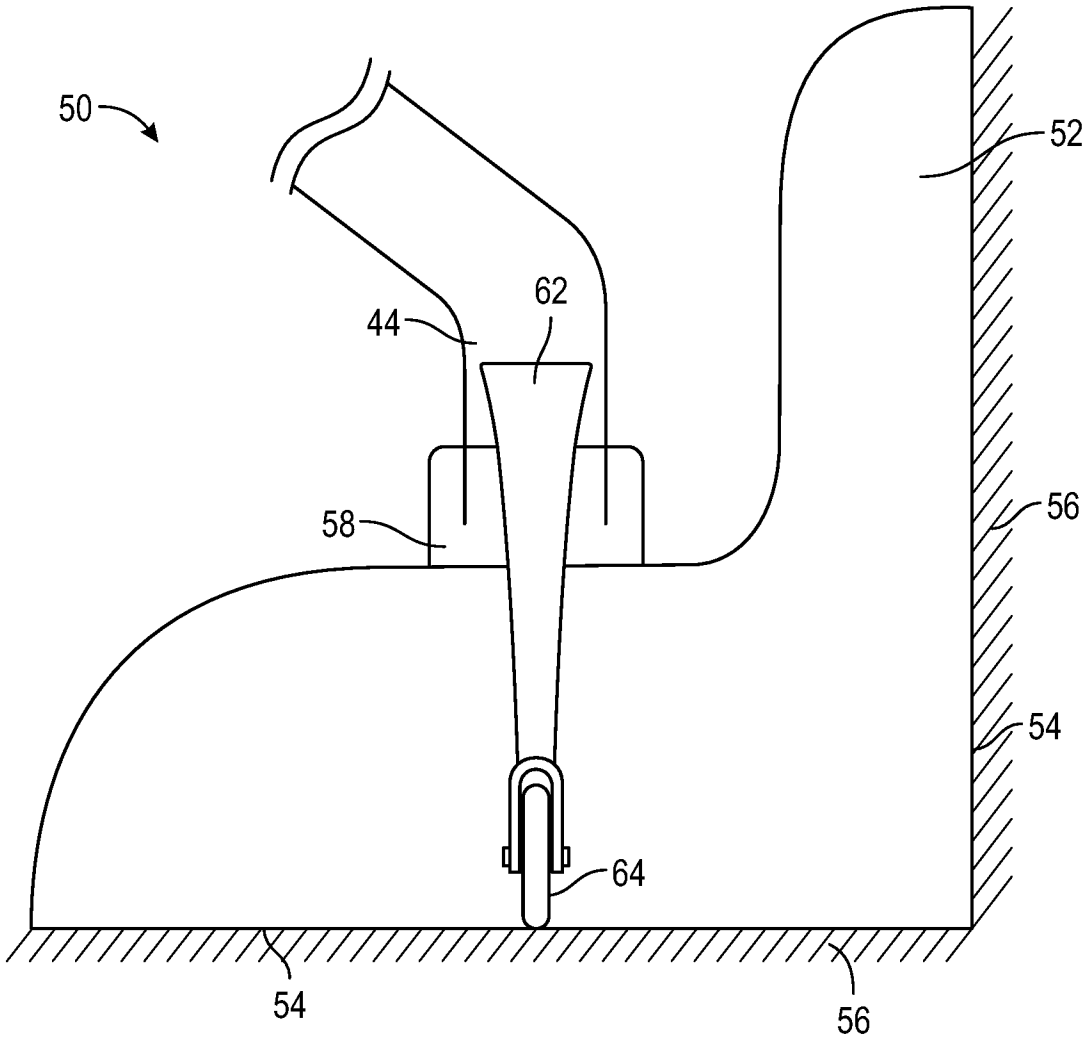
FIG. 3 illustrates a side view of the baseboard cleaning attachment 50, in accordance with one embodiment of the present invention.

The vacuum system 10 further comprises a baseboard cleaning attachment 50 removably mounted to the hose 42 or support handle 44. The baseboard cleaning attachment 50 might be used to vacuum dust and debris on floor and/or at baseboards. As known, the baseboards are used to cover the joint between wall surface and the floor. Referring to FIGS. 1 and 3, the baseboard cleaning attachment 50 is explained. The baseboard cleaning attachment 50 comprises a brush head 52 made up of plastic, metal or any other material. The brush head 52 comprises a right-angled portion, and a curved portion opposite to the right-angled portion. The brush head 52 comprises a mouth 54 indicative of open structure at the right-angled portion and the curved portion forms a closed structure. In one example, the brush head 52 is provided with bristles 56 at the mouth 54 i.e., at the right-angled portion. The brush head 52 further comprises a neck 58. As can be seen in FIG. 3, the neck 58 is provided at the curved portion of the brush head 52. The neck 58 may be removably mounted to the hose 42 or support handle 44 in order to the mount the baseboard cleaning attachment 50 to the housing 12 via the hose 42 and support handle 44. Further, the baseboard cleaning attachment 50 comprises a support leg 62 provided behind or beside the brush head 52 as shown in FIG. 1. The support leg 62 is provided with a first wheel 64 for maneuvering the baseboard cleaning attachment 50 over the floor when the baseboard cleaning attachment 50 is used for vacuuming the baseboards. It should be understood that the first wheel 64 is mounted to the neck 58 in such a way that the first wheel 64 remains in the back of the brush head 52 when the brush head 52 is turn around.

Now referring to FIGS. 1 to 3, operation of the vacuum system 10 for cleaning or vacuuming the baseboard is explained. In order to vacuum the baseboard and/or floor, the user of the vacuum system 10 may carry the housing 12 with the help of the handle 30 or placing the shoulder straps 32 over his shoulder. The user may power ON the vacuum system 10 by actuating the actuator 34. When actuated, the motor 24 draws power from the battery 26 or other power sources such as a wall outlet with alternating current and activates the pump 22. The pump 22 then creates suction through the suction tube 18. Due to the suction created, air including dust and debris is sucked into the dust collection chamber 16 through the inlet 14, support handle 44 is mounted to hose 42 and cleaning attachment 50. As presented above, one end of the hose 42 is mounted to the inlet 14 and other end is mounted to the baseboard cleaning attachment 50. As such, air including dust and debris from the right-angled portion of the brush head 52 is sucked into the dust collection chamber 16.

In order to vacuum the floor or the baseboard, the user may adjust or align the right-angled portion of the brush head 52 along the corners of the walls i.e., facing the baseboard and the wall. Due to the suction created by the pump 22, the dust and debris accumulated at the baseboard is sucked into the brush head 52 at the right-angled portion and then collected in the dust collection chamber 16 thereby cleaning or vacuuming the baseboard. The user may move or maneuver the baseboard cleaning attachment 50 across the length of the baseboard with the help of the first wheel 64. The user may maneuver the baseboard cleaning attachment 50 with the help of the hose 42 to draw the dust and debris into the inlet 14 through the neck 58, the support handle 44 and the hose 42. The dust and debris sucked into the inlet 14 is collected in the dust collection chamber 16. As specified above, the dust collection chamber 16 includes the filter 18. The filter 18 stops the dust and debris and allows the dust and debris to accumulate in the dust collection chamber 16. Further, air that is relatively clean gets past the filter 18 and is dispensed into the atmosphere or environment through the exhaust port 28. After completion of vacuuming the floor and the baseboards, the dust collection chamber 16 might be removed from the housing 12 to dispose off the dust and debris collected and put back in the housing 12.

As the support handle 44 is removably mounted to the baseboard cleaning attachment 50, the support handle 44 can be removed and mounted in desired direction so to make the right-angled portion of the brush head 52 to face the baseboard or corners of the wall. As such, the baseboards in different orientation or direction can be cleaned or vacuumed with the help of the baseboard cleaning attachment 50. Further, the first wheel 64 allows maneuvering the baseboard cleaning attachment 50 over the floor. As such, position of the baseboard cleaning attachment 50 can be adjusted to vacuum the baseboard. The hose 42 is selected having suitable length so that the user need not have to bend or kneel down to reach the baseboard with the baseboard cleaning attachment 50 for vacuuming the baseboard. Similarly, the support handle 44 of suitable length might be selected so that the user need not have to bend or kneel down to reach the baseboard with the baseboard cleaning attachment 50 for vacuuming the baseboard.

The vacuum system 10 might be used as a vacuum cleaner as known in the art for cleaning or vacuuming floor and/or baseboard. In one example, the baseboard cleaning attachment 50 might be provided with existing vacuum cleaners as an additional accessory that can be removably mounted to the hose 42 or support handle 44 or inlet 14 for cleaning the baseboards or corner of the walls. Alternatively, the baseboard cleaning attachment 50 might be provided as a standard accessory with new vacuum cleaners for vacuuming the baseboards or corner of the walls.

Although it is shown that the baseboard cleaning attachment 50 is mounted to the support handle 44, a person skilled in the art will appreciate that the baseboard cleaning attachment 50 might be mounted to the hose 42 without the need for the support handle 44.

Based on the above, it is evident that the vacuum system 10 including the baseboard cleaning attachment 50 for cleaning baseboards without having to bend or kneel down.

Now referring to FIGS. 4 to 8, a vacuum system 100 that allows cleaning underneath furniture without moving the furniture is explained, in accordance with one embodiment of the present invention.

In the current embodiment, the vacuum system 100 is provided with another cleaning attachment for vacuuming under furniture without having to move the furniture. The vacuum system 100 includes a housing 102. The housing 102 might indicate a container, a casing, or receptacle made up of metal, plastic or any other suitable material. The housing 102 might be provided in variety of shapes and sizes depending upon the need. The housing 102 may include an inlet, a dust collection chamber, a suction tube, a filter, a pum, a motor, a battery, and an exhaust port. A person skilled in the art will appreciate that inlet, the dust collection chamber, the suction tube, the filter, the pump, the motor, the battery, and the exhaust port may have similar constructional features and function as explained above.

The vacuum system 100 further includes a handle 104 for allowing a user to hold the housing 102. The housing 102 is provided with shoulder straps 106 for supporting the housing 102 over shoulders of the user. Further, the vacuum system 100 includes a hose 108 removably mounted to the inlet. The hose 108 might be made up of rigid or flexible material. Further, the hose 108 might be selected having suitable length based on the need.

The vacuum system 100 further includes a floor cleaning attachment 110 removably mounted to the hose 108. The floor cleaning attachment 110 includes an elongated tube 112. The elongated tube 112 may indicate a hollow tube made up of rigid or flexible material. In one preferred embodiment, the elongated tube 112 made up of rigid material is selected. Further, the elongated tube 112 includes a second wheel 114 at approximately center of its length. As can be seen, one end of the elongated tube 112 is mounted to the hose 108 and other end is mounted to a beater head 120.

Figure 5:
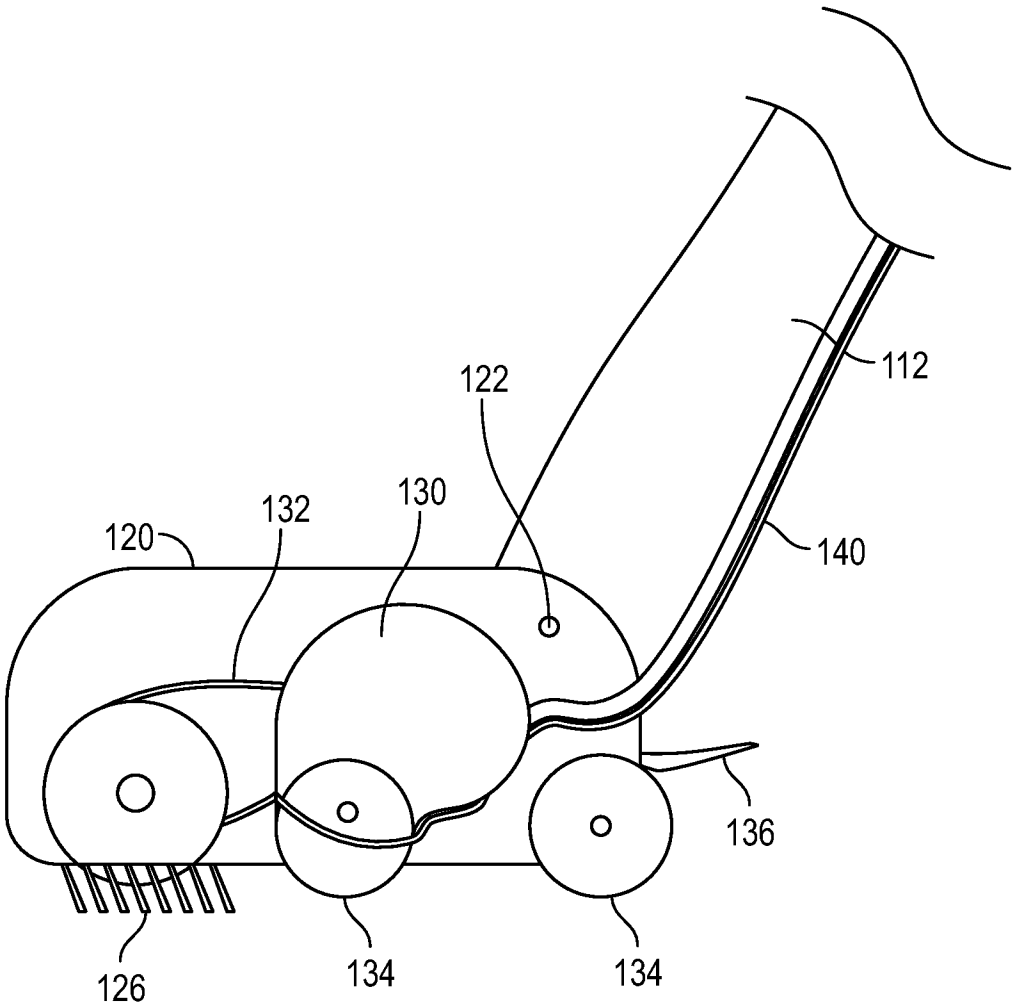
FIG. 5 illustrates a side view of a beater head 120 of the floor cleaning attachment 110, in accordance with one embodiment of the present invention.
Figure 6:
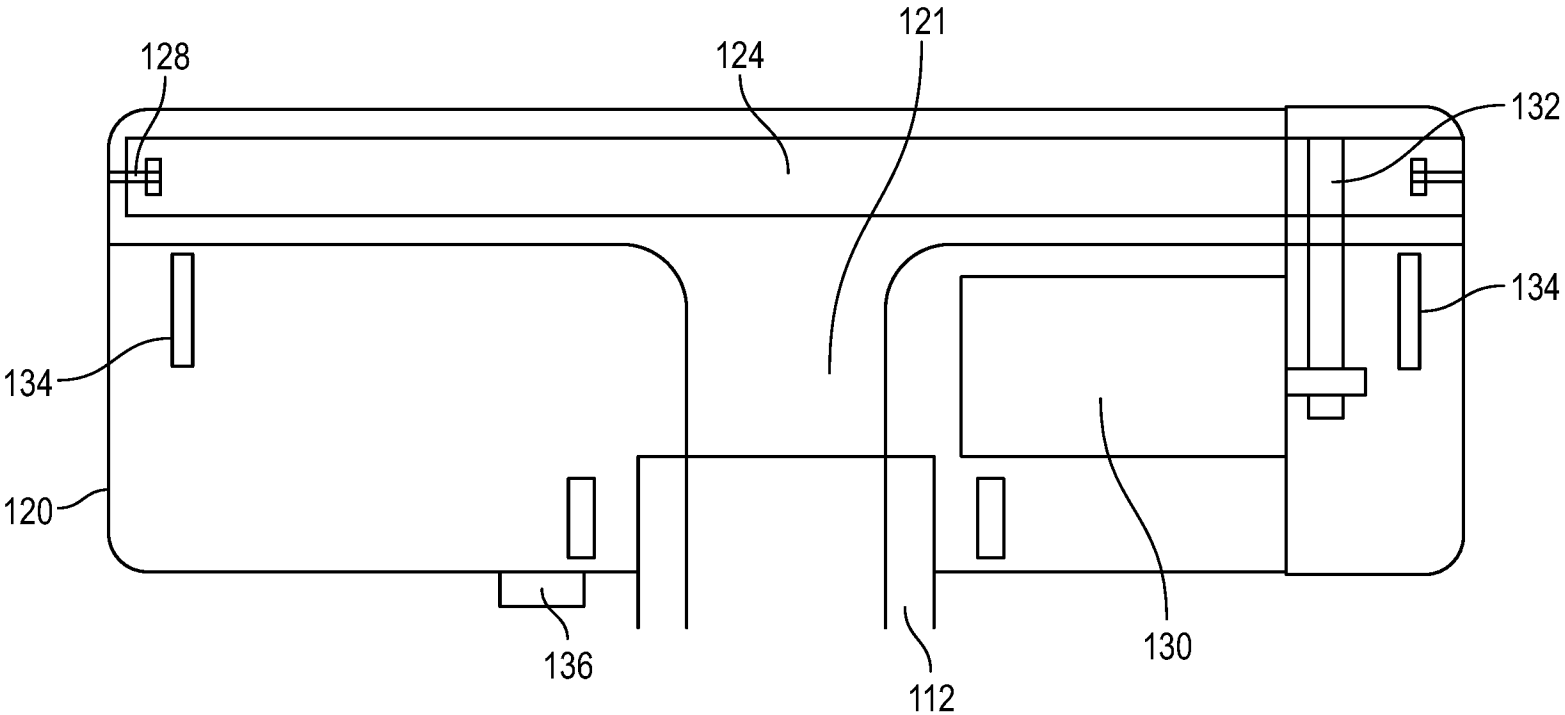
FIG. 6 illustrates a top view of a beater head 120 of the floor cleaning attachment 110, in accordance with one embodiment of the present invention.

Referring to FIGS. 5 and 6, a side and top view, respectively of the beater head 120 is shown, in accordance with one embodiment of the present invention. It should be understood that the shape and size showed herein is provided for illustrative purpose only, a person skilled in the art will understand that the components shown herein can be provided in different shapes and sizes. In one example, the beater head 120 might be provided in a rectangular shape as shown in FIG. 6. However, it should be understood that the beater head 120 might be provided in any other shape such as a square. Further, the beater head 120 might be made up of plastic, metal or any other material. In the present embodiment, the beater head 120 is provided with a beater neck 121. The beater neck 121 might be used mounted to the elongated tube 112. In one example, the beater neck 121 might be mounted to the elongated tube 112 at a first pivot 122.

The beater head 120 may comprise a beater bar 124 having bristles 126. The beater bar 124 might be mounted to the beater head 120 with the help of an axle 128 having a bearing. The beater bar 124 constantly rotates when the power is received.

Figure 4:
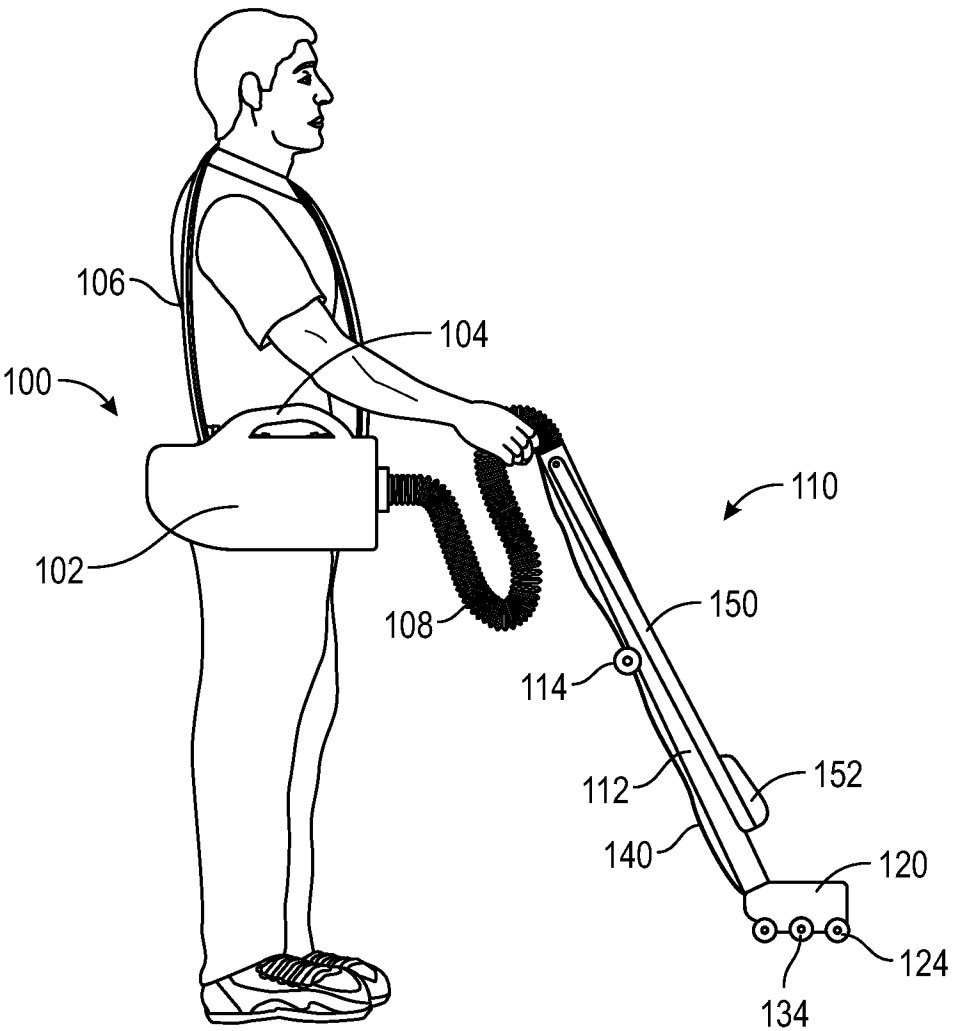
FIG. 4 illustrates a side view of a vacuum system 100 includes a floor cleaning attachment 110, in accordance with another embodiment of the present invention.
Figure 7:
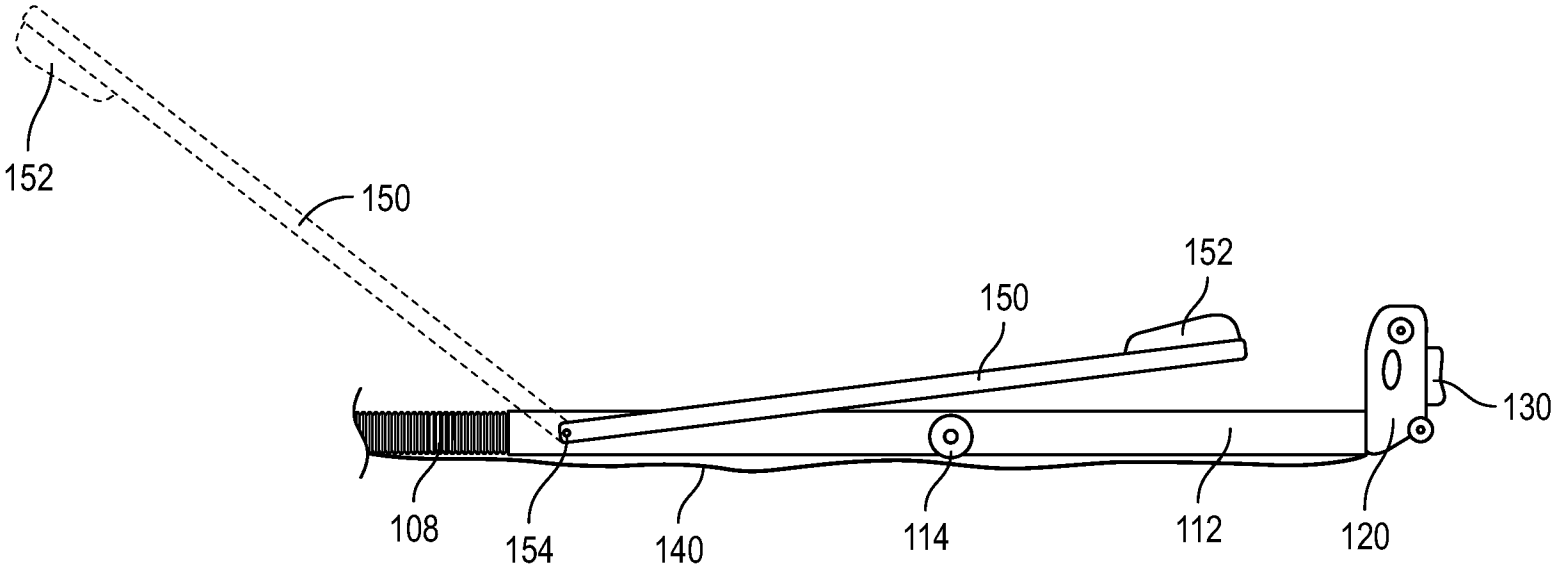
FIG. 7 illustrates a side view of the floor cleaning attachment 110 includes an elongated tube 112, and an under furniture handle 150 used for vacuuming the floor, in accordance with one embodiment of the present invention.

The beater head 120 further includes a beater motor 130 mounted to the beater bar 124 via a drive belt 132. Further, the beater neck 121 includes third wheels 134 facing the floor. The third wheels 134 are used for maneuvering the beater head 120 on the floor. The beater head 120 further includes a knob or lock 136 for locking position of the elongated tube 112 with respect to the beater head 120. The user of the vacuum system 100 may operate the knob 136 to lock the position of the elongated tube 112 with respect to the beater head 120 during or after cleaning the floor with the vacuum system 100. The beater head 120 further includes a cable 140 extending from the beater motor 130 to a beater plug, similar to the beater plug 38 shown in FIG. 1. As can be seen in FIGS. 4, 5 and 7, the cable 140 is drawn along the elongated tube 112, the hose 108 and mounted to the beater plug provided at the housing 102.

Now referring to FIG. 4, the vacuum system 100 includes an under furniture handle 150. As can be seen, one end of the under furniture handle 150 is mounted to the elongated tube 120 and other end is provided with a head portion 150. The head portion 152 may indicate a bump-like structure at the far end of the under furniture handle 150. It should be understood that the under furniture handle 150 is shorter in length than the elongated tube 120. In one example, the under furniture handle 150 might be provided in 3/4$^{th}$ of the length of the elongated tube 120. The under furniture handle 150 is mounted to the elongated tube 112 using a second pivot 154. As such, the under furniture handle 150 is pivotable with respect to the elongated tube 112. Referring to FIG. 7, an example illustration in which the under furniture handle 150 is pivoted from a relatively flat position to a raised position is shown, in accordance with one embodiment of the present invention. As can be seen from FIG. 7, the under furniture handle 150 is placed on the elongated tube 112 when in flat position.

Figure 8:
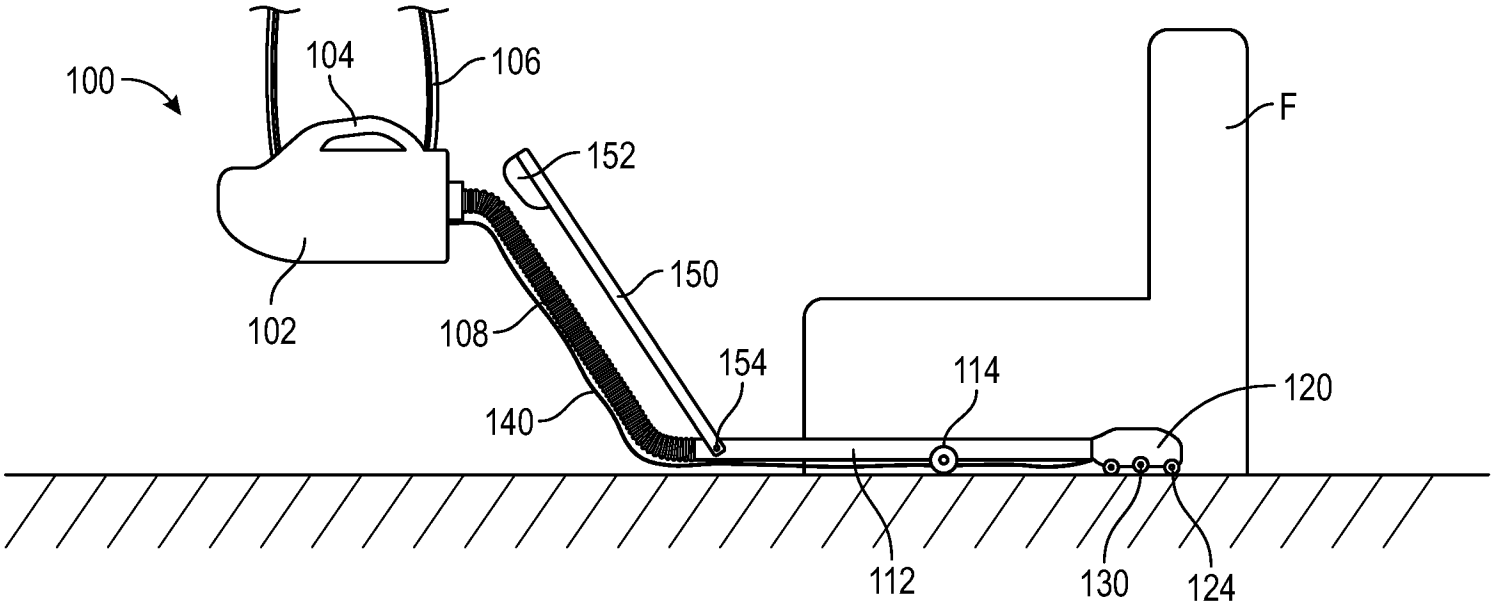
FIG. 8 illustrates a side view of the vacuum system 100 in which the elongated tube 112 is laid flat on the floor to vacuum under furniture F, in accordance with one exemplary embodiment of the present invention.
Figure 9:
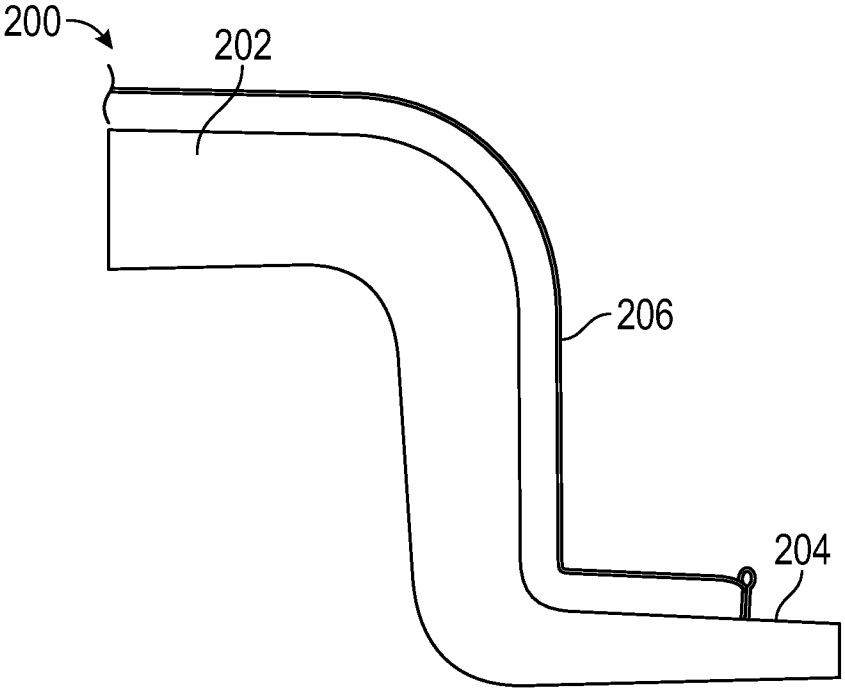
FIG. 9 illustrates a hose attachment 200 used for vacuuming tight spaces, in accordance with another embodiment of the present invention.

Referring to FIGS. 4 and 8, operation of the vacuum system 100 for vacuuming under furniture F without bending or getting down on hands and knees on the floor is explained. At first, the hose 108 is mounted to the inlet of the housing 102. Further, the elongated tube 112 is mounted to the hose 108. Subsequently, the beater head 120 is mounted to the elongated tube 112 at the beater neck 121. As specified above, the under furniture handle 150 is mounted to the elongated tube 112 with the help of the second pivot 154.

When the user needs to vacuum the floor under the furniture F, the user may position the beater head 120 in that the bristles 126 face the floor. Whenever the user can stand and vacuum the floor, the under furniture handle 150 is made to hang down with respect to the elongated tube 112 as shown in FIG. 4. In the current scenario, the user may actuate the actuator such that the beater motor 130 is activated to rotate the beater bar 124 to position the bristles 126 to face the floor. Subsequently, the user may operate the actuator such that first motor in the housing 102 activates the pump. The pump then creates suction through the suction tube. Due to the suction created, air is sucked into the dust collection chamber through the inlet. As presented above, one end of the hose 108 is mounted to the inlet and other end is mounted to the elongated tube 112. The elongated tube 112 is further mounted to the beater head 120. The beater head 120 sucks dust and debris, and the dust and debris is collected in the dust collection chamber. In other words, the bristles 126 on the beater bar 124 is wrapped completely around the beater bar 124 such that when the beater bar 124 is spinning, the bristles 126 brush the floor throwing dirt up into the beater head 120 to be sucked up through the hose 108 into the dust collection chamber 16. While collecting the dirt and the debris, the user may maneuver the beater head 120 with the help of the elongated tube 112. It should be understood that the third wheels 134 provided at the beater neck 121 helps to maneuver the beater head 120 across the floor. The user may move around the floor or ground G and adjust the position of the beater neck 121 to properly align the beater head 120 to vacuum on the floor.

In order to vacuum the floor under the furniture F, the user may raise the under furniture handle 150 and hold the head portion 152. Subsequently, the user may use the under furniture handle 150 to position the elongated tube 112 to lay flat on the floor and place the beater head 120 under the furniture F. When the elongated tube 112 is laid flat, the elongated tube 112 rest on the second wheel 114. The user may operate the under furniture handle 150 to maneuver the elongated tube 112 with the help of the second wheel 114 until the beater head 120 goes under the furniture F. upon reaching, the user may operate the first motor to vacuum the dust and debris under the furniture F through the beater head 120, the hose 108, the inlet, and the dust collection chamber.

After vacuuming the dust and debris under the furniture F, the user may put back the under furniture handle 150 on the elongated tube 112 and continue vacuuming the floor.

Based on the above, it is evident that the user can vacuum the floor under the furniture F or any other structure with the help of the floor cleaning attachment 110 without moving the furniture F or bending or getting down on hands and knees on the floor.

In order to further help the user to clean the dust and debris in tight spots including corners or small spaces, the vacuum system 100 might be provided with a hose attachment 200. The hose attachment 200 might be provided in a S-shape. The hose attachment 200 might be made up of metal, plastic or any other material. The hose attachment 200 might be provided in a hollow structure made using rigid or flexible material. The hose attachment 200 includes a first end 202 and a second end 204. The first end 202 may have larger opening than the second end 204. In one exemplary embodiment, the hose attachment 200 might be provided with a cable 206. In one implementation, the first end 202 might be mounted to the vacuum system 100 i.e., at the inlet of the vacuum system 100. In order to attach the hose attachment 200 to the vacuum system 100, the user may remove the beater head 120 from the elongated tube 112 and put on the hose attachment 200. Subsequently, the cable 206 might be used to mount to the beater plug to power the beater motor 130. Upon mounting, the second end 204 might be used to reach tight spots such that suction is created to clean the dust and debris.

Although the baseboard cleaning attachment 50, the floor cleaning attachment 110 and the hose attachment 200 are different in their use, they can be provided as a kit with the vacuum cleaners for vacuuming the floors and baseboards. Based on the need, the user may selectively mount the baseboard cleaning attachment 50, the floor cleaning attachment 110 and the hose attachment 200 to the hose and vacuum the floors and baseboards without having to bend or getting down on hands and knees on the floor.

As the vacuum system is provided with the handle and the shoulder straps, the user may hold the handle to vacuum the baseboards, floor and tight spaces without having to bend or get down on hands and knees on floor. Further, the shoulder straps might be used to carry the weight of the vacuum system while vacuuming the baseboards, floor and tight spaces.

Further, the vacuum system can be operated using the battery or alternating current from a power source. When the present invention is not plugged directly to a power source the battery can be used to power the present invention for full functionality. As such, the vacuum system can be used as a standalone device without the need for electricity or cables for vacuuming stairs, vehicles, rooms in the house etc.

It should be understood that shape, size and placement of the each components shown in figures are provided for illustrative purpose only and should not be construed in limited sense. A person skilled in the art will appreciate alternate parts and/or mechanisms might be used to implement the embodiments of the present invention and such implementations will be within the scope of the present invention.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A vacuum for vacuuming, the vacuum comprising:

a housing including an inlet, a dust collection chamber mounted to the inlet, a suction tube mounted to the dust collection chamber via a filter, wherein the suction tube is further mounted to a pump, a first motor mounted to the pump, an exhaust port mounted to the filter and a hose mounted to the inlet;

a floor cleaning attachment including an elongated tube including a beater head, and wherein the beater head includes a beater bar and an under-furniture handle pivotally mounted to the elongated tube; and a baseboard cleaning attachment including a brush head including a first portion and a second portion, wherein the first portion and a second portion are perpendicularly connected, wherein a first outer side of the first portion is entirely flat and includes bristles, wherein a second outer side of the second portion is entirely flat and includes the bristles, wherein a neck is connected to a first curved side opposite to the first outer side of the first portion, wherein an external surface of said brush head includes a support leg attached thereon, wherein said support leg tapers inwardly from a proximal end to a distal end, wherein said distal end of the support leg is provided with a first wheel wherein the first motor operates the pump to create suction via the suction tube, wherein the suction tube is configured to create suction in the dust collection tube, the inlet and the hose, wherein the elongated tube is removably mounted to the hose, and the under furniture handle is configured to be used to lay the elongated tube on a floor such that the beater head is configured to face the floor under furniture, wherein the first motor is configured to vacuum the floor under the furniture, collecting dust and debris in the dust collection tube, and wherein the filter is configured to ensure that clean air is released through the exhaust port, wherein the neck of the baseboard cleaning attachment is removably mounted to the hose, and the first outer side and the second outer side are configured to face baseboards, wherein the first motor is configured to vacuum the baseboards collecting dust in the dust collection tube, and wherein one of the floor cleaning attachment and the baseboard cleaning attachment is selectively mounted to the hose for vacuuming.

2. The vacuum of claim 1, wherein the elongated tube includes a second wheel for maneuvering the elongated tube on the floor.

3. The vacuum of claim 1, wherein the beater bar is rotatably mounted to the beater head using an axle.

4. The vacuum of claim 1, further includes a beater plug provided in the housing for operating the beater bar.

5. The vacuum of claim 4, wherein the beater head is provided with a beater motor for operating the beater bar, and wherein the beater motor is electrically connected to the beater plug via a cable.

6. The vacuum of claim 1, wherein the beater head is provided with third wheels for maneuvering the beater head on the floor.

7. The vacuum of claim 1, optionally comprises a hose attachment removably mounted to the hose for vacuuming corners or tight spaces on the floor.

8. The vacuum of claim 7, wherein the hose attachment is provided in a S-shape, wherein the hose attachment includes a first end and a second end, wherein the first end diameter is larger than the second end, and wherein the first end is mounted to the hose.

9. The vacuum of claim 1, wherein said beater bar includes bristles.

10. A vacuum for vacuuming, the vacuum comprising:

a housing including an inlet, a dust collection chamber mounted to the inlet, a suction tube mounted to the dust collection chamber via a filter, wherein the suction tube is further mounted to a pump, a first motor mounted to the pump, an exhaust port mounted to the filter and a hose mounted to the inlet;

a floor cleaning attachment including an elongated tube including a beater head, and wherein the beater head includes a beater bar and an under-furniture handle pivotally mounted to the elongated tube; and a baseboard cleaning attachment including a brush head including a first portion and a second portion, wherein the first portion and a second portion are perpendicularly connected, wherein a first outer side of the first portion is entirely flat and includes bristles, wherein a second outer side of the second portion is entirely flat and includes the bristles, wherein a neck is connected to a first curved side opposite to the first outer side of the first portion, wherein an external surface of said brush head includes a support leg attached thereon, wherein said support leg tapers inwardly from a proximal end to a distal end, wherein said distal end of the support leg is provided with a first wheel wherein the first motor operates the pump to create suction via the suction tube, wherein the suction tube is configured to create suction in the dust collection tube, the inlet and the hose, wherein the elongated tube is removably mounted to the hose, and the under furniture handle is configured to be used to lay the elongated tube on a floor such that the beater head is configured to face the floor under furniture, wherein the first motor is configured to vacuum the floor under the furniture collecting dust and debris in the dust collection tube, and wherein the filter is configured to ensure that clean air is released through the exhaust port, wherein the neck of the baseboard cleaning attachment is removably mounted to the hose, and the first outer side and the second outer side are configured to face baseboards, wherein the first motor is configured to vacuum the baseboards collecting dust in the dust collection tube, and wherein one of the floor cleaning attachment and the baseboard cleaning attachment is selectively mounted to the hose for vacuuming, wherein the beater head is provided with third wheels for maneuvering the beater head on the floor, wherein the hose attachment is provided in a S-shape, wherein the hose attachment includes a first end and a second end, wherein the first end diameter is larger than the second end, and wherein the first end is mounted to the hose.

11. A vacuum for vacuuming, the vacuum consisting of:

a housing including an inlet, a dust collection chamber mounted to the inlet, a suction tube mounted to the dust collection chamber via a filter, wherein the suction tube is further mounted to a pump, a first motor mounted to the pump, an exhaust port mounted to the filter and a hose mounted to the inlet;

a floor cleaning attachment including an elongated tube including a beater head, and wherein the beater head includes a beater bar and an under-furniture handle pivotally mounted to the elongated tube; and a baseboard cleaning attachment including a brush head including a first portion and a second portion, wherein the first portion and a second portion are perpendicularly connected, wherein a first outer side of the first portion is entirely flat and includes bristles, wherein a second outer side of the second portion is entirely flat and includes the bristles, wherein a neck is connected to a first curved side opposite to the first outer side of the first portion, wherein an external surface of said brush head includes a support leg attached thereon, wherein said support leg tapers inwardly from a proximal end to a distal end, wherein said distal end of the support leg is provided with a first wheel wherein the first motor operates the pump to create suction via the suction tube, wherein the suction tube is configured to create suction in the dust collection tube, the inlet and the hose, wherein the elongated tube is removably mounted to the hose, and the under furniture handle is configured to be used to lay the elongated tube on a floor such that the beater head is configured to face the floor under furniture, wherein the first motor is configured to vacuum the floor under the furniture collecting dust and debris in the dust collection tube, and wherein the filter is configured to ensure that clean air is released through the exhaust port, wherein the neck of the baseboard cleaning attachment is removably mounted to the hose, and the first outer side and the second outer side are configured to face baseboards, wherein the first motor is configured to vacuum the baseboards collecting dust in the dust collection tube, and wherein one of the floor cleaning attachment and the baseboard cleaning attachment is selectively mounted to the hose for vacuuming, wherein the beater head is provided with third wheels for maneuvering the beater head on the floor, wherein the hose attachment is provided in a S-shape, wherein the hose attachment includes a first end and a second end, wherein the first end diameter is larger than the second end, and wherein the first end is mounted to the hose, wherein the elongated tube includes a second wheel for maneuvering the elongated tube on the floor, wherein the beater head is provided with a beater motor for operating the beater bar, and wherein the beater motor is electrically connected to the beater plug via a cable.

* * * * *